US005806778A

United States Patent [19]

Yanagimoto

[11] Patent Number: 5,806,778

[45] Date of Patent: Sep. 15, 1998

[54] CARTRIDGE ADAPTER

[75] Inventor: Takekazu Yanagimoto, Kanagawa, Japan

[73] Assignee: Fuji Photo Film Co., Ltd., Kanagawa, Japan

[21] Appl. No.: 831,651

[22] Filed: Apr. 9, 1997

[30] Foreign Application Priority Data

Apr. 15, 1996 [JP] Japan ..... 8-092746

[51] Int. Cl.[6] ..... G03D 13/08

[52] U.S. Cl. ..... 242/348.4

[58] Field of Search ..... 242/348, 348.3, 242/348.4

[56] References Cited

U.S. PATENT DOCUMENTS

| | | | |
|---|---|---|---|
| 3,568,587 | 3/1971 | Laval . | |
| 4,834,306 | 5/1989 | Robertson et al. . | |
| 4,949,114 | 8/1990 | Combat et al. . | |
| 5,280,860 | 1/1994 | Kataoka | 242/348.3 |
| 5,311,237 | 5/1994 | Kawada et al. . | |
| 5,357,303 | 10/1994 | Wirt | 242/348.4 |
| 5,564,644 | 10/1996 | Masuda | 242/348.4 |

*Primary Examiner*—John P. Darling

*Attorney, Agent, or Firm*—Sughrue, Mion, Zinn, Macpeak & Seas, PLLC

[57] ABSTRACT

A cartridge adapter, comprising: a case into which a cartridge of a photographic film is loaded, the cartridge, including: a door for shielding an entrance/exit port of the photographic film; a door shaft which is rotated in a first direction so as to open the door and release the shielding of the entrance/exit port, the door shaft being rotated in a second direction which is the direction opposite the first direction so as to close the door and shield the entrance/exit port; and a spool shaft which is rotated in a third direction so that the photographic film is wound around the spool shaft, the spool shaft being rotated in a fourth direction which is the direction opposite the third direction so that the photographic film is conveyed out of the entrance/exit port; and a shaft body which is axially supported by the case so as to be rotatable and which engages with the door shaft of the cartridge loaded into the case, wherein the case is provided with a slit port which, when the photographic film is loaded into and unloaded from the cartridge, guides the photographic film and an opening portion which exposes the end of the spool shaft of the cartridge loaded into the case. Therefore, in a state in which the cartridge is loaded into the cartridge adapter, the cartridge can be conveyed in and out via the opening portion.

20 Claims, 10 Drawing Sheets

CARTRIDGE ADAPTER

BACKGROUND OF THE INVENTION

1. Field of the Invention:

The present invention relates to a cartridge adapter which accommodates a cartridge so that a photographic film, which has been taken up onto a spool shaft, can be loaded and unloaded.

2. Description of the Related Art:

In recent years, a system has been proposed in which a developed film is taken up in a roll form without being cut, is accommodated within a cartridge, and thereafter, is returned to a customer.

In a case in which a film is test-printed and color-corrected or in a case in which a film is checked with prints, it is necessary to withdraw the developed film taken up onto a cartridge.

In this case, conventionally, as illustrated in FIG. 10, an operation is undertaken in which a driver 44 is inserted through a key hole 42 of a door shaft 40 and rotated so as to open a door 36, and further, an exclusive driver 50 is inserted through a key hole 48 of a spool shaft 46 so as to rotate the spool shaft 46, and thereafter, a film F is withdrawn from an entrance/exit port 28.

However, when the film F is directly withdrawn from a cartridge 12, since the film F is curled, image frames may contact the door 36 and are damaged. Further, because the dimensional accuracy of the key hole 42 of the door shaft 40 is strictly set, when the driver 44 is inserted accidentally, the key hole 42 may be worn or damaged.

SUMMARY OF THE INVENTION

With the aforementioned in view, an object of the present invention is to provide a cartridge adapter which can load and unload a film, without damaging the film and a key hole of a door shaft.

A first aspect of the present invention is a cartridge adapter, comprising:

a case into which a cartridge of a photographic film is loaded, the cartridge, including: a door for shielding an entrance/exit port of the photographic film; a door shaft which is rotated in a first direction so as to open the door and release the shielding of the entrance/exit port, the door shaft being rotated in a second direction which is the direction opposite the first direction so as to close the door and shield the entrance/exit port; and a spool shaft which is rotated in a third direction so that the photographic film is wound around the spool shaft, the spool shaft being rotated in a fourth direction which is the direction opposite the third direction so that the photographic film is conveyed out of the entrance/exit port; and a shaft body which is axially supported by the case so as to be rotatable and which engages with the door shaft of the cartridge loaded into the case, wherein the case is provided with a slit port which, when the photographic film is loaded into and unloaded from the cartridge, guides the photographic film and an opening portion which exposes the end of the spool shaft of the cartridge loaded into the case.

The first aspect is used for an operation in which the door shaft is rotated in the first direction so as to open the door which shields the entrance/exit port of the cartridge and in which the photographic film is loaded into and unloaded from the entrance/exit port.

Firstly, the cartridge is loaded into the case so that the shaft body engages with the door shaft. Here, the shaft body is rotated, and the door shaft is rotated in the first direction so as to open the door.

Next, the spool shaft is rotated in the winding-out direction, i.e., the fourth direction, of the photographic film via the opening portion. Accordingly, the distal end of the photographic film is conveyed out of the entrance/exit port via the slit port.

Since the distal end of the photographic film is guided from the entrance/exit port to the slit port in this way, even if the photographic film is curled, the film will not contact the door. As a result, damage to the image frames of the photographic film can be prevented.

A second aspect of the present invention is a cartridge adapter according to the first aspect, wherein the engagement between the door shaft and the shaft body is effected via a first key hole provided at the door shaft, and a second key hole, which engages with a driver for rotating the spool shaft, and which is formed at the spool shaft.

In the above-described second aspect, the first key hole is formed at the door shaft, and when the cartridge is loaded into the case, the shaft body and the door shaft engage. Here, the shaft body is rotated from the outer side of the case by using a jig, and the door shaft is rotated in the first direction so as to open the door. In this way, because the door shaft is rotated via the shaft body, the first key hole will not be damaged easily.

Next, the driver for operation is inserted through the second key hole of the spool shaft from the opening portion, and the spool shaft is rotated in the winding-out direction (the fourth direction) of the photographic film. As a result, the photographic film is conveyed out of the entrance/exit port and the slit port.

A third aspect of the present invention is a cartridge adapter according to the first or second aspect, wherein the slit port is formed at a position which corresponds to the door of the cartridge loaded into the case, and an edge portion of the case which forms the slit port is covered by non-woven fabric.

In the above-described third aspect, the slit port is formed at the position which corresponds to the door of the cartridge loaded into the case. The edge portion of the case which forms the slit port is covered by non-woven fabric so that, when the photographic film passes through the slit port, damage to the photographic film is prevented. Moreover, when the photographic film is rewound around the spool shaft, because the photographic film is moved while contacting the non-woven fabric, predetermined friction acts on the photographic film nipped by the non-woven fabric. Accordingly, so-called back tension acts on the photographic film and the photographic film can be rewound around the spool shaft without slack. Further, the dust or the like attached to the photographic film can be removed by the non-woven fabric.

A fourth aspect of the present invention is a cartridge adapter, comprising:

a box having a loading portion into which a cartridge of a photographic film is loaded, the cartridge, including: a door for shielding an entrance/exit port of the photographic film; a door shaft which is rotated in a first direction so as to open the door and release the shielding of the entrance/exit port, the door shaft being rotated in a second direction which is the direction opposite the first direction so as to close the door and shield the entrance/exit port; and a spool shaft which is rotated in a third direction so that the photographic film is wound around the spool shaft, the spool shaft being rotated in a fourth direction which is the direction opposite the third direction so that the photographic film is conveyed out of the entrance/exit port;

a lid which is formed so as to be placed at an opened position at which the cartridge is able to be loaded into the loading portion and at a closed position at which the cartridge is contained at the loading portion; and a shaft body which engages with the door shaft of the cartridge loaded into the box, wherein a slit port which, when the photographic film is loaded into and unloaded from the cartridge, guides the photographic film is formed between the box and the lid placed at the closed position, and the box includes an opening portion which exposes the end of the spool shaft of the cartridge loaded into the box.

In the fourth aspect, the door shaft of the cartridge engages with the shaft body, the cartridge is rotated around the shaft body, and the cartridge is loaded into the loading portion. Due to the rotation of the cartridge, the door shaft is rotated in the first direction via the shaft body so as to automatically open the door. Conversely, when the cartridge is unloaded from the loading portion, the cartridge is rotated in the direction opposite the first direction. Due to the rotation of the cartridge, the door shaft is rotated in the second direction so as to automatically close the door.

Next, after the cartridge is loaded into the loading portion, the lid is placed at the closed position and the cartridge is contained at the loading portion by the box and the lid. Further, when the lid is placed at the closed position, the slit port is formed between the box and the lid. Here, the spool shaft is rotated in the conveying direction (the fourth direction) of the photographic film via the opening portion. As a result, the distal end of the photographic film is conveyed out of the entrance/exit port via the slit port.

In this way, when the cartridge is loaded into or unloaded from the loading portion of the box, since the lid is placed at the opened position, the cartridge can be easily handled. Further, as the cartridge is loaded into and unloaded from the loading portion, the door is automatically opened and closed. Consequently, it is not necessary to have a jig for opening and closing the door.

A fifth aspect of the present invention is a cartridge adapter according to the fourth aspect, wherein the engagement between the door shaft and the shaft body is effected via a first key hole provided at the shaft body, and a second key hole, which engages with a driver for rotating the spool shaft, and which is formed at the spool shaft.

In the above-described fifth aspect, the first key hole is formed at the door shaft. The shaft body of the box engages with the first key hole such that the shaft body of the box is rotatably supported to the loading portion of the cartridge. Moreover, the driver for operation is inserted through the second key hole of the spool shaft from the opening portion, and the spool shaft is rotated in the winding-out direction (the fourth direction) of the photographic film.

A sixth aspect of the present invention is a cartridge adapter according to the fourth or fifth aspect, wherein the slit port is placed at a position which corresponds to the door of the cartridge loaded into the box, and an edge portion of the box and an edge portion of the lid which form the slit port are covered by non-woven fabric.

In the sixth aspect, the edge portion of the lid and the edge portion of the box which form the slit port are covered by the non-woven fabric. Accordingly, when the photographic film passes through the slit port, the photographic film will not be damaged.

A seventh aspect of the present invention is a cartridge adapter according to the fifth or sixth aspect, wherein guide means which guides the cartridge is formed at the box, such that, when the cartridge is loaded into the loading portion, the guide means holds a portion which forms the entrance/exit port of the cartridge, and the cartridge is slid along the axial direction of the door shaft, and the shaft body and the first key hole of the door shaft are engaged.

In the above-described seventh aspect, the portion which forms the entrance/exit port of the cartridge is held at the guide means formed at the box, and the cartridge is slid along the axial direction of the door shaft. Accordingly, the first key hole of the door shaft engages with the shaft body. In this way, as the cartridge is slid along the axial direction of the door shaft by using the guide means, the first key hole is engaged with the shaft body without being gnawed and the wear or the like of the first key hole can be prevented.

An eighth aspect of the present invention is a cartridge adapter, wherein the lid is rotatably supported by the box so that the lid is positioned at the opened position and the closed position, the lid includes stopper means which stops the rotation of the lid in the direction of the opened position so that the angle of opening of the box and the lid forms a predetermined angle at the opened position, and the lid includes a guide portion which is formed at the lid and when the cartridge is guided by the guide means in a state in which the lid is positioned at the opened position, a predetermined portion of the cartridge slides.

In the above-described eighth aspect, the stopper means is provided. When the opened position of the lid forms the predetermined angle with respect to the box, the stopper means stops the rotation of the lid in the opened position. The guide portion is provided at the lid. In a state in which the portion which forms the entrance/exit port of the cartridge is held at the guide means, the predetermined portion of the cartridge contacts the guide portion and the cartridge can slide against the guide means and the guide portion.

In this way, as the cartridge contacts slide surfaces of the guide means and the guide portion, the cartridge smoothly slides along the axial direction of the door shaft. Further, when the cartridge adapter is stood upright so that the slide surfaces of the guide means and the guide portion are substantially perpendicular to the ground, the first key hole of the door shaft automatically engages with the shaft body by simply dropping the cartridge into the loading portion.

A ninth aspect of the present invention is a cartridge adapter, further comprising: a controlling projection in which, when the photographic film passes through the slit port, movements of the photographic film in the transverse direction are controlled.

In the ninth aspect, while the photographic film passes through the slit port, movements of the photographic film are controlled by the controlling projection. Accordingly, the photographic film can be conveyed out of or rewound from the slit port without meandering.

A tenth aspect of the present invention is a cartridge adapter, wherein the box is provided with an opening for extrusion, in which the cartridge loaded into the loading portion is able to be extruded from the loading portion.

In the tenth aspect, the opening for extrusion is formed at the box, e.g., the bottom portion thereof. Consequently, as the operator simply inserts his/her fingers through the opening for extrusion and pushes up the cartridge, the cartridge can be unloaded from the loading portion while being rotated.

An eleventh aspect of the present invention is a cartridge adapter, further comprising: lock means which, when the lid is placed at the closed position, maintains the closed position.

In the eleventh aspect, when the box is closed by the lid, i.e., when the lid is placed at the closed position, the closed state is kept by the lock means. Therefore, in order to keep the lid at the closed position, there is no need to press the lid with fingers.

A twelfth aspect of the present invention is a cartridge adapter, further comprising: a shielding member which shields the opening portion of the box so that the interior of the loading portion is in the state of a darkroom.

In the twelfth aspect, the opening portion of the box is shielded by the shielding member so that the interior of the loading portion is in the state of a darkroom. As a result, an undeveloped photographic film can be conveyed out of the cartridge.

For example, in the developing process of the photographic film, at first, the cartridge, in which the undeveloped negative photographic film is wound around the spool shaft, is set to the cartridge adapter. Next, the cartridge adapter is set to the negative developing apparatus, and in the negative developing apparatus which is in the state of a darkroom, the spool shaft is rotated in the fourth direction such that the photographic film is conveyed out of the slit port. Lastly, the rear end of the photographic film is cut and the photographic film accommodated within the cartridge is entirely conveyed to the negative developing apparatus.

In this way, by having the state of a darkroom, the cartridge adapter can be set to the outer side of the negative developing apparatus provided in the illuminated room.

The rear end of the developed photographic film is reshaped and the rear end portion remaining at the spool shaft is removed. Thus, the cartridge is ready for accommodating a new developed photographic film.

DESCRIPTION OF THE PREFERRED EMBODIMENTS

Figure 1:
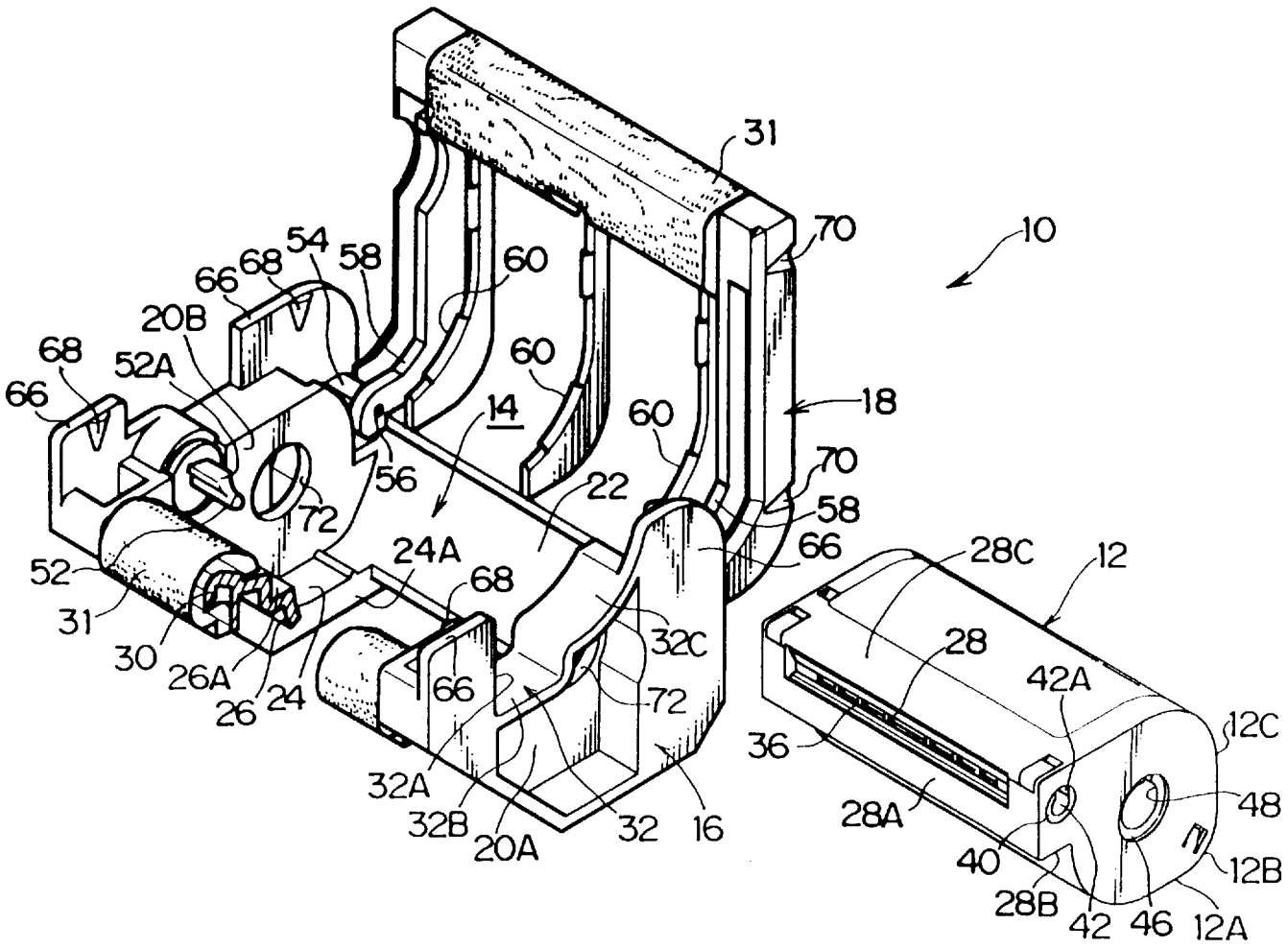
FIG. 1 is a perspective view which shows a state in which a lid of a cartridge adapter relating to a first embodiment is opened.

As illustrated in FIG. 1, a cartridge adapter 10 relating to a first embodiment is structured by a box 16 which is formed by a loading portion 14, into which a cartridge 12 is loaded, and a lid 18 which covers an opening of the box 16.

An inner dimension between two side walls 20A, 20B which form the loading portion 14 is substantially the same as the width of the cartridge 12 so as to limit movements with play of the loaded cartridge 12 in the transverse direction thereof. Moreover, a bottom plate 24 is suspended at the lower portions of the side walls 20A, 20B. The central portion of the bottom plate 24 is opened so as to form an extruding port 24A. An operator thrusts his/her fingers into the extruding port 24A and pushes a bottom portion 12A of the cartridge 12, such that the cartridge 12 can be unloaded from the loading portion 14.

Further, a receiving plate 22 which is bent upwardly is formed at the rear side of the bottom plate 24. A portion over a bent surface 12B of the cartridge 12 and an upright surface 12C thereof is held at the receiving plate 22.

Additionally, in the front direction of the bottom plate 24, a supporting plate 26, which includes a step portion 26A, is suspended between the side walls 20A, 20B. A front surface 28A and a lower surface 28B, which are in the vicinity of an entrance/exit port 28 of the cartridge 12, are formed at the step portion 26A. Further, a holding piece 30 juts out forwardly. A teremp 31 is wound around the holding piece 30 so that damage to the film F is prevented.

Figure 2:
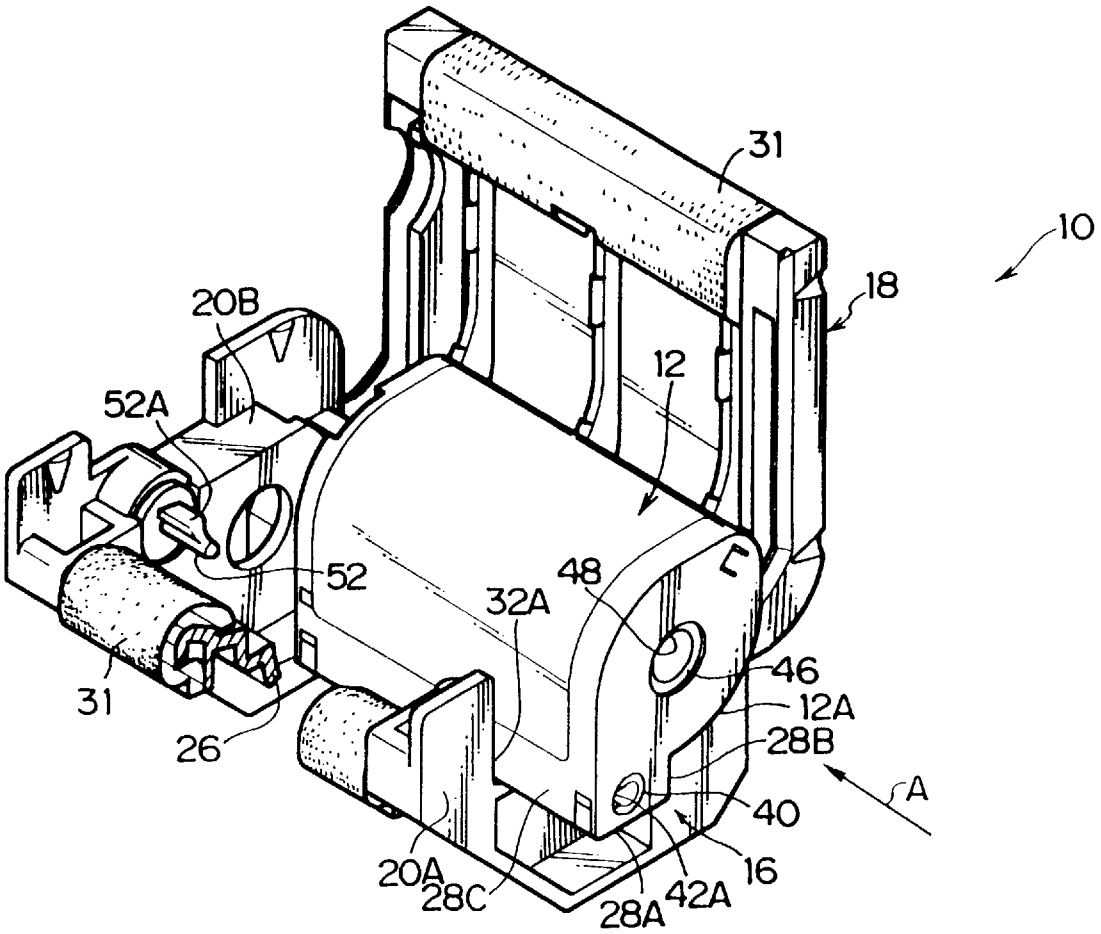
FIG. 2 is a perspective view which shows a state in which a cartridge is set to a guide groove of the cartridge adapter relating to the first embodiment.
Figure 3:
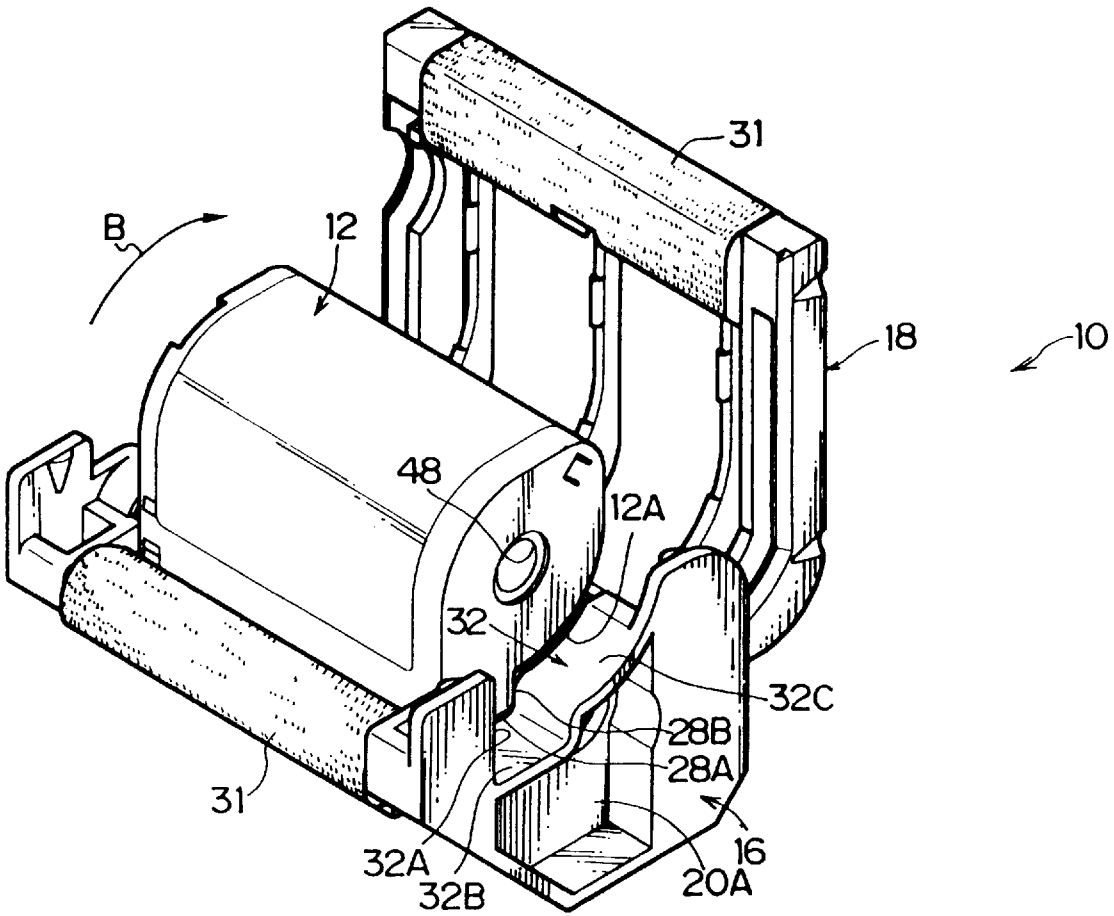
FIG. 3 is a perspective view which shows a state in which the cartridge is pressed into a shaft body of the cartridge adapter relating to the first embodiment.

A guide groove 32, which partially holds the cartridge 12 and guides the cartridge 12 along the axial direction of a door shaft 40, is formed at the upper portion of the side wall 20A. As illustrated in FIGS. 2 and 3, the guide groove 32 is formed by an upright wall 32A, which slides against an upper surface 28C which is in the vicinity of the entrance/exit port 28 of the cartridge 12, a bottom wall 32B, which slides against the front surface 28A, and a bent wall 32C, which slides against the portion over the lower surface 28B and the bottom portion 12A.

Accordingly, the cartridge 12 can be slid in the direction of arrow A while the vertical position of the cartridge 12 is maintained.

Further, at the other side wall 20B, a shaft body 52 projects toward the guide groove 32. As illustrated in FIG. 2, in a state in which the cartridge 12 is held at the guide groove 32, the shaft body 52 is provided so that the shaft body 52 is positioned on the axis of the door shaft 40. Moreover, a key 52A is formed at the shaft body 52. When the cartridge 12 is set to the guide groove 32 in a state in which a door 36 is closed, the key 52A is positioned so as to correspond to a key groove 42A of the door shaft 40.

On the other hand, a pair of shaft portions 54 are formed at the upper portion ends of the receiving plate 22. A pin 56 projects from each of the shaft portions 54, and a pair of arms 58, which jut out from the reverse surface of the lid 18, are axially supported by the pins 56. Additionally, ribs 60 are provided between the arms 58 so as to reinforce the density of the lid 18. At the same time, when the lid 18 is closed, the ribs 60 press and hold the upper portion of the cartridge 12 so that the cartridge 12 does not move with play.

Figure 5:
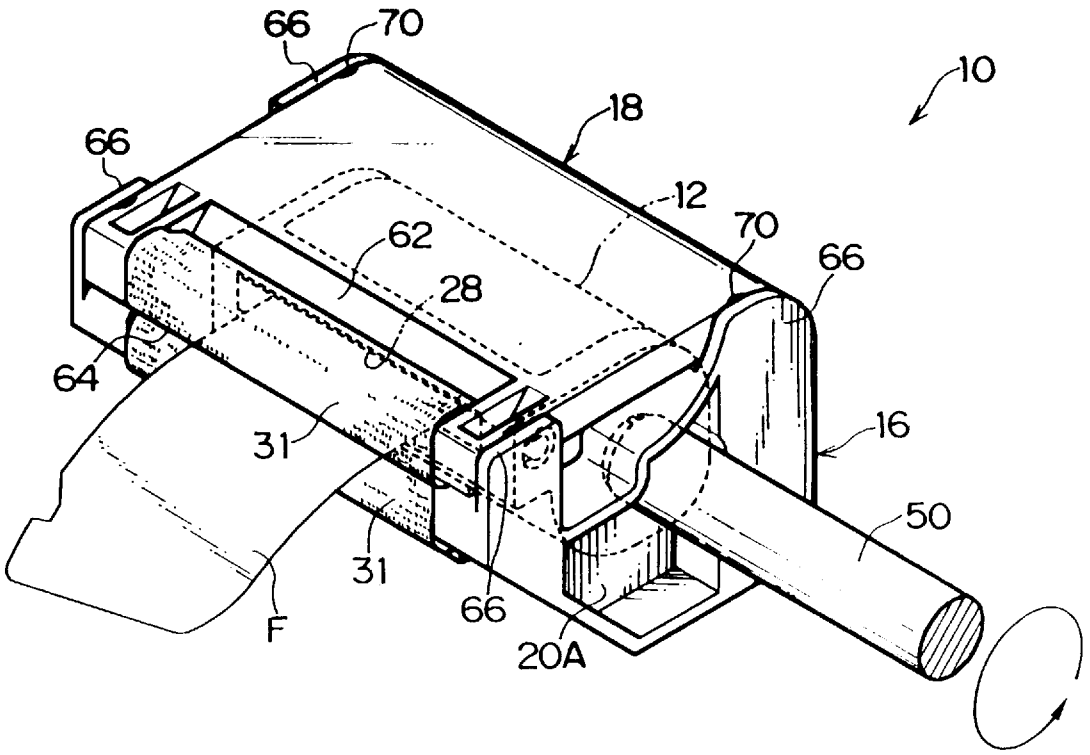
FIG. 5 is a perspective view which shows a state in which the film is withdrawn from the cartridge loaded into the cartridge adapter relating to the first embodiment.

Further, as shown in FIG. 5, a depressed portion 62 is formed at the free end side of the lid 18 along the transverse direction thereof. The teremp 31 is wound around over the depressed portion 62 and the reverse surface of the lid 18. By this teremp 31 and the teremp 31 provided at the box 16 side, when the lid 18 is closed, a slit port 64, from which the film F is withdrawn, is formed.

Moreover, an engaging plate 66 stands upright from each of the front sides and rear sides of the side walls 20A, 20B. A semi-conical pawl 68 is provided at the respective inner sides of the engaging plates 66. When the lid 18 is closed, a concave portion 70, which is caved in at the outer surface of the lid 18 so as to correspond to the position of the pawl 68, engages the pawl 68, such that the lid 18 is locked in a closed state.

Further, a circular hole 72 penetrates through the side walls 20A, 20B so that the driver 50 can be inserted through a key hole 48 of the spool shaft 46 of the cartridge 12, which has been loaded into the loading portion 14.

Next, the function of the cartridge adapter 10 relating to the first embodiment will be explained.

As illustrated in FIG. 2, the film F is loaded into the guide groove 32 with the entrance/exit port 28 of the cartridge 12, within which the film F has been accommodated, facing downwardly. At this time, the door 36 of the cartridge 12 is closed.

Next, as illustrated in FIG. 3, when the cartridge 12 is slid along the guide groove 32 (along the axial direction of the door shaft 40), a key hole 42 of the door shaft 40 engages with the key 52A of the shaft body 52. In this way, as the cartridge 12 slides along the guide groove 32, the key hole 42 of the door shaft 40 accurately engages with the shaft body 52 in the axial direction of the door shaft 40. Accordingly, the key hole 42 is not gnawed and wear or the like of the key hole 42 can be prevented.

Figure 4:
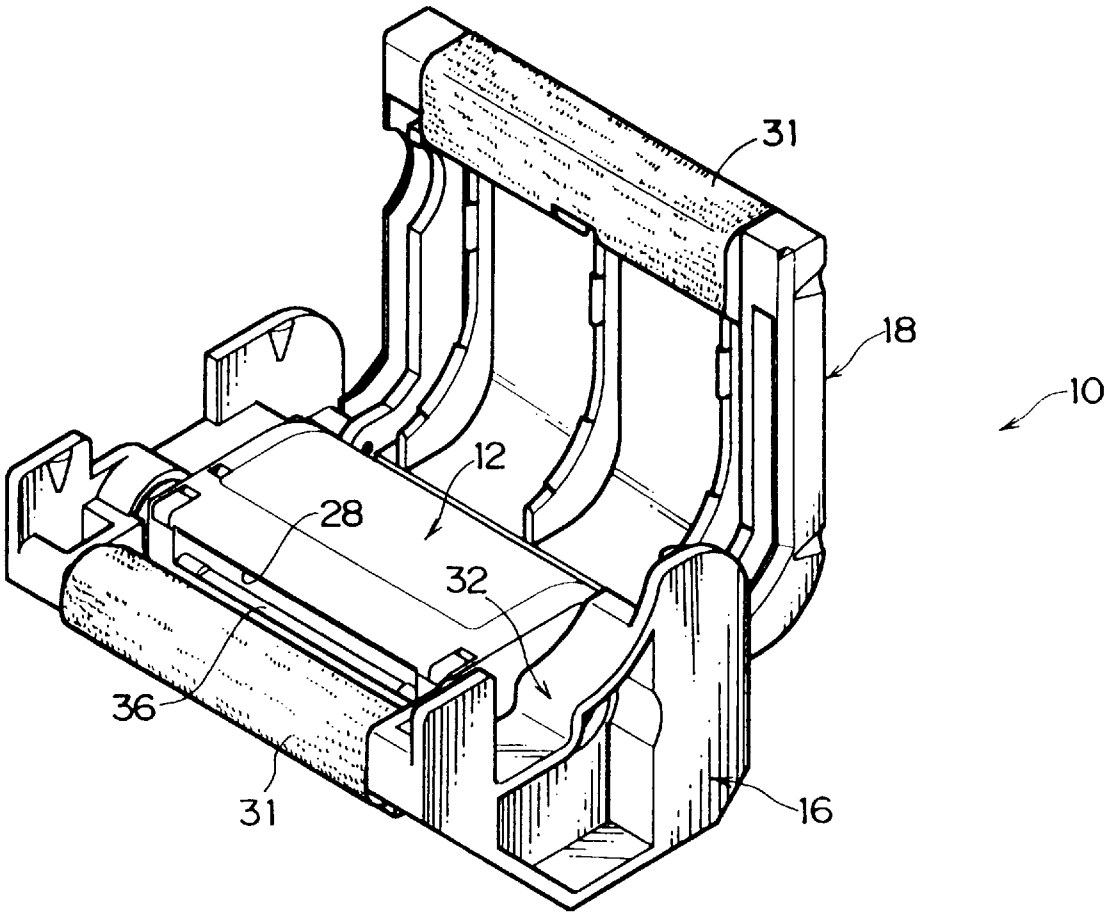
FIG. 4 is a perspective view which shows a state in which the cartridge is loaded into the cartridge adapter relating to the first embodiment.

Next, the cartridge 12 is rotated around the shaft body 52 in the direction of arrow B, and as shown in FIG. 4, the cartridge 12 is loaded into the loading portion 14. Due to the rotation of the cartridge 12, the door shaft 40 is rotated and the door 36 automatically opens.

As illustrated in FIG. 5, when the lid 18 is closed, the pawl 68 engages with the concave portion 70. Consequently, the lid 18 is locked and the cartridge 12 is held at the loading portion 14.

At this time, the slit port 64 is formed by the teremp 31 mounted to the free end portion of the lid 18 and the teremp 31 mounted to the holding piece 30 of the box 16.

Next, the driver 50 is inserted through the circular hole 72 and engages with the key hole 48 of the spool shaft 46. When the driver 50 is rotated, the distal end of the film F is conveyed out of the entrance/exit port 28 via the slit port 64. Since the slit port 64 is formed by the teremp 31, the film F is not damaged.

Further, because the distal end of the film F is guided from the entrance/exit port 28 to the slit port 64, even if the film F is curled, the film F does not contact the door 36. As a result, damage to the image frames can be prevented.

Moreover, when the film F is rewound, predetermined friction acts upon the film F which has been nipped by the teremps 31. Accordingly, so-called back tension acts upon the film F and the film F can be wound around the spool shaft 46 without slack. Additionally, dust or the like which has been attached to the film F can be removed by the teremps 31.

On the other hand, when an operator wants to unload the cartridge 12 from the cartridge adapter 10, he/she opens the lid 18, inserts his/her fingers into the extruding port 24A and extrudes the cartridge 12 from the loading portion 14 so as to rotate the cartridge 12. Consequently, the cartridge 12 is rotated around the shaft body 52 and the door 36 automatically closes. As a result, closing of the door 36 is effected without fail.

Figure 6:
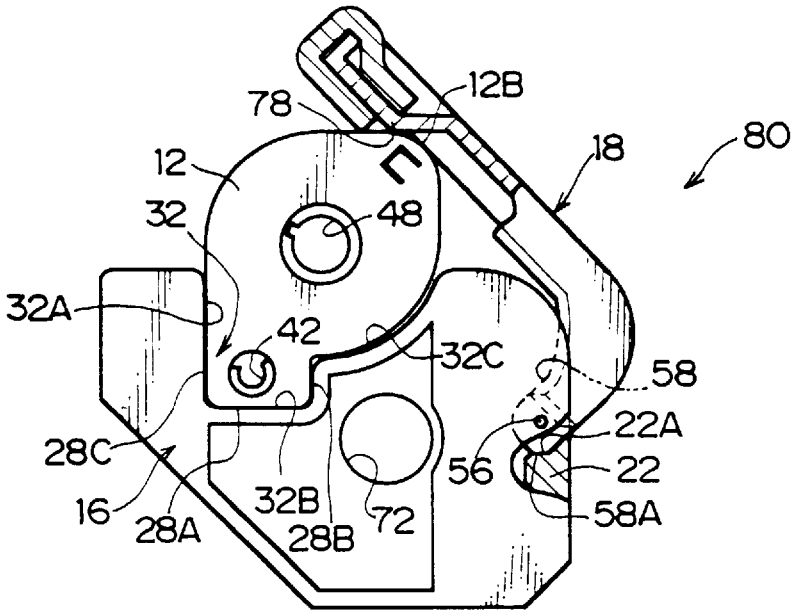
FIG. 6 is a perspective view which shows a variant example of the cartridge adapter.

In the first embodiment, the guide groove 32 is provided as means of guiding the key hole 42 of the door shaft 40 of the cartridge 12 to the shaft body 52. However, as a cartridge adapter 80 shown in FIG. 6, in a state in which the cartridge 12 is held at the guide groove 32, a guide portion 78, which abuts a portion 12B of the cartridge 12, may be formed on the reverse surface of the lid 18.

Accordingly, the cartridge 12 guided by the two portions of the cartridge adapter 80 and the cartridge 12, slides along the axial direction of the door shaft 40 without vibrations. Further, when the cartridge adapter 80 is stood upright, the key hole 42 of the door shaft 40 automatically engages with the shaft body 52 by simply dropping the cartridge 12 from the upper portion of the cartridge adapter 80.

Moreover, a stopper surface 22A, which has been cut out in the rectangular shape, is formed on the receiving plate 22. A base end portion 58A of an arm 58 abuts the stopper surface 22A and the lid 18 stops at a certain angle of opening. At this time, the guide portion 78 is positioned so as to abut the portion 12B of the cartridge 12.

Next, a cartridge adapter 82 relating to a second embodiment will be explained.

Figure 7:
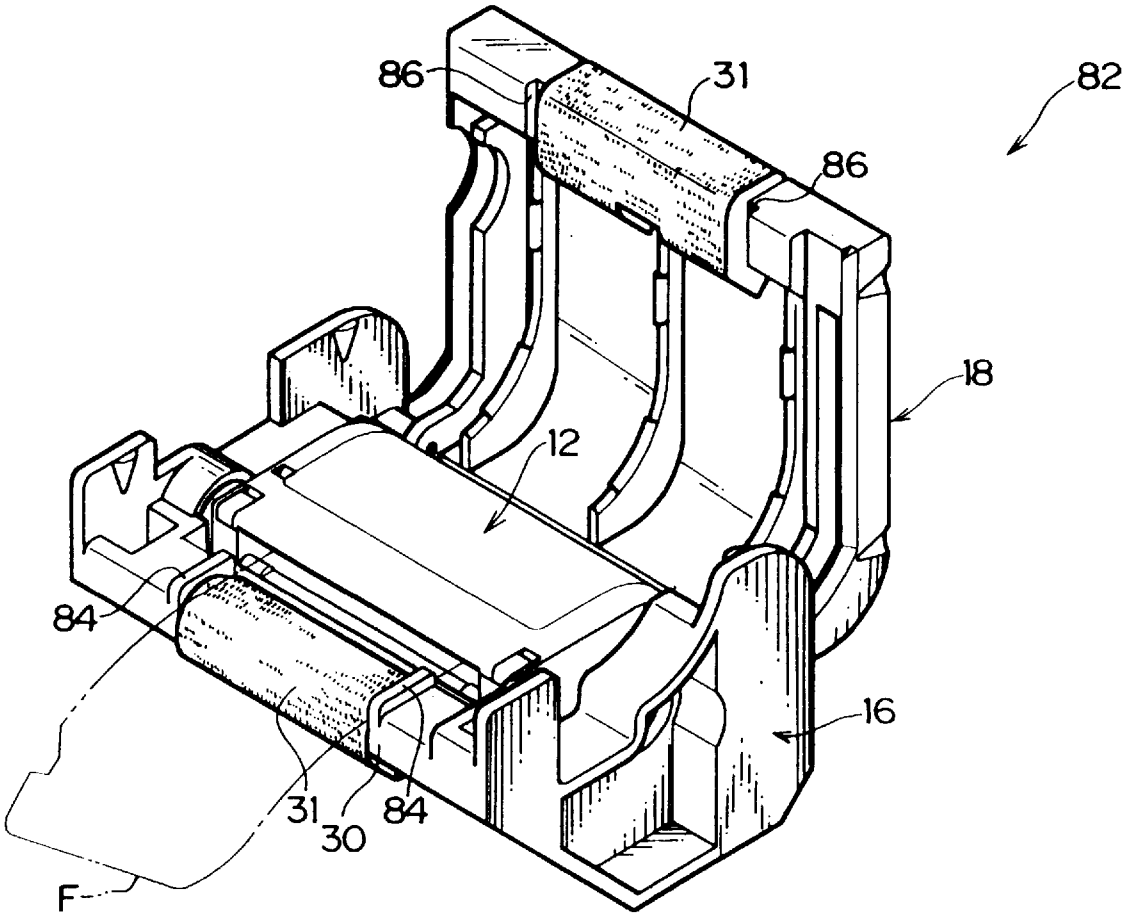
FIG. 7 is a perspective view which shows a state in which a cartridge is loaded into a cartridge adapter relating to a second embodiment.

In the second embodiment, as illustrated in FIG. 7, a pair of guide projections 84 stand upright near the center of the holding piece 30. The width of the guide projections 84 is substantially the same as the width of a film F. Moreover, a teremp 31 is wound around the portion between the guide projections 84.

On the other hand, at the free end side of a lid 18, two lateral grooves 86 are formed so that, when the lid 18 is closed, the lateral grooves 86 engage with the guide projections 84. Additionally, a teremp 31 is wound around the portion between the lateral grooves 86.

As a result, vibrations of the film F in the transverse direction thereof are controlled by the guide projections 84, and the film F is conveyed out of or rewound from the slit port without meandering.

Figure 8:
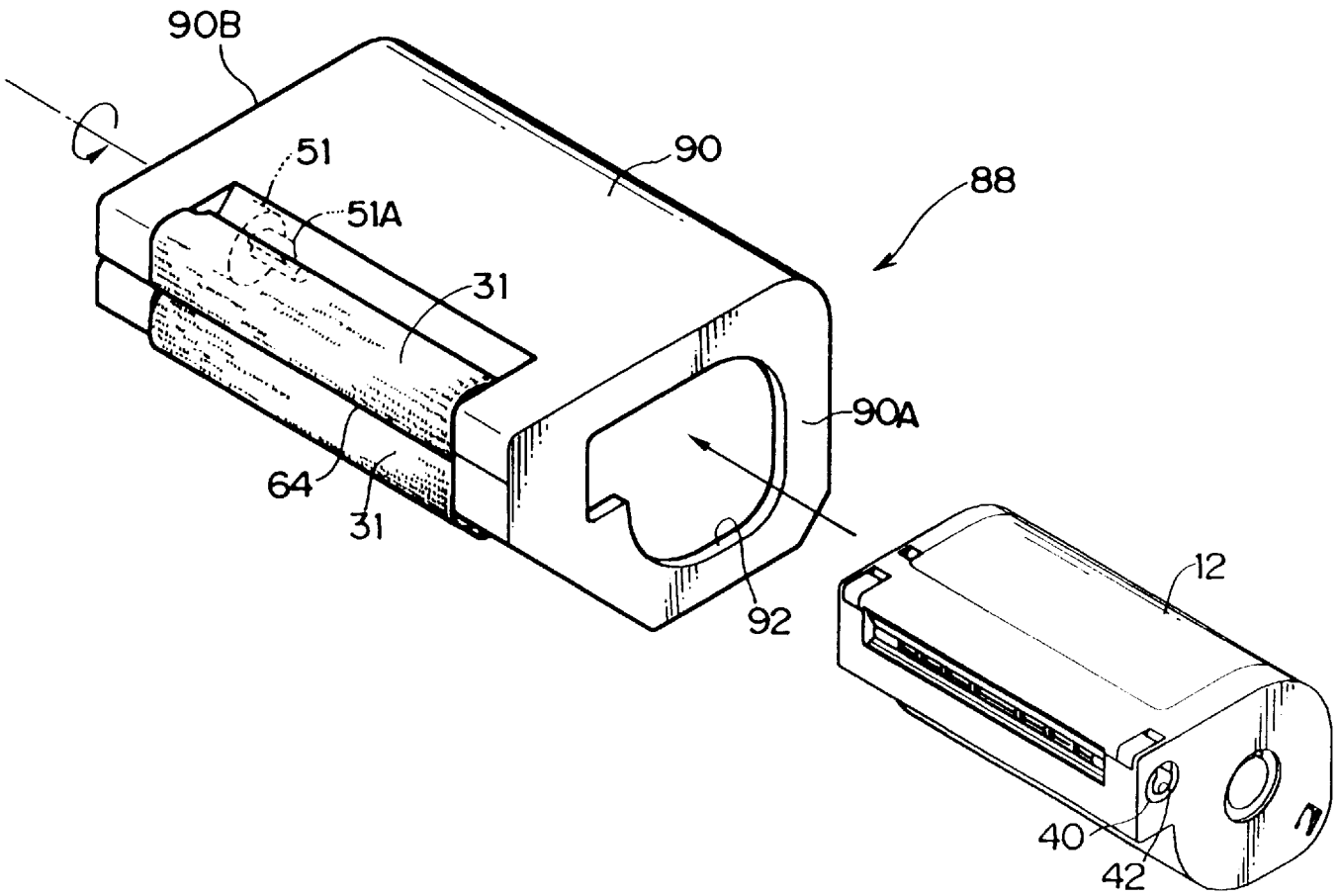
FIG. 8 is a perspective view of a cartridge adapter relating to a third embodiment.

All of the aforementioned cartridge adapters 10, 80, 82 include the lids which can be opened and closed. However, as a cartridge adapter 88 of a third embodiment shown in FIG. 8, an opening portion 92, through which a cartridge 12 is inserted, may be formed at one of two side walls 90A of a box-shaped case 90 so that the cartridge 12 is loaded thereinto. In the third embodiment, a shaft body 51 is rotatable and is rotated by using a jig from the outer side of the case 90. However, because a door shaft 40 is rotated via the shaft body 51, a key hole 42 is not damaged.

Moreover, it is preferable that a plate, which indicates the rotational position of a key 51A of the shaft body 51, is attached to the side wall 90A of the case 90.

Figure 9:
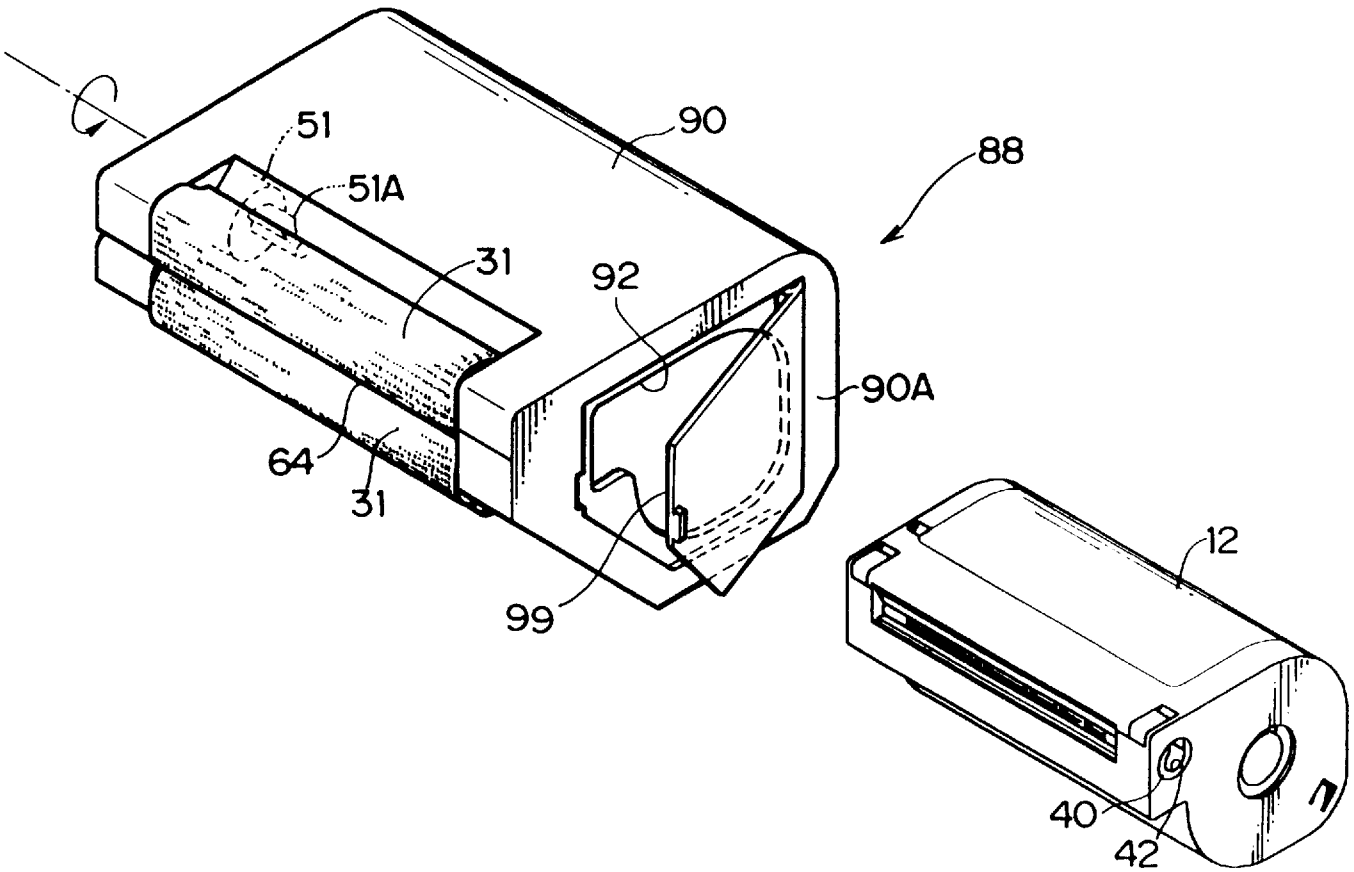
FIG. 9 is a perspective view of a cartridge adapter relating to a variant example of the third embodiment.
Figure 10:
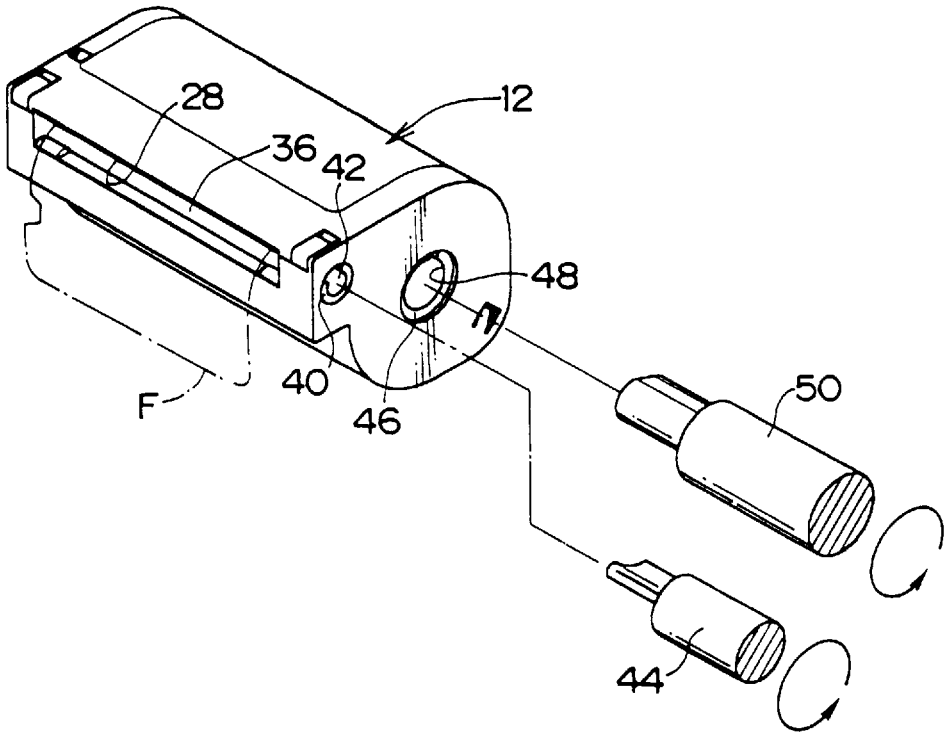
FIG. 10 PRIOR ART
FIG. 10 is a perspective view which shows a conventional method of directly withdrawing a film from a cartridge.

Further, as a shading member such as a cover or a shutter which shields the opening of a cartridge adapter is provided, the interior of the cartridge adapter is in the state of a darkroom. As the structure of the cartridge adapter is in the state of a darkroom, an undeveloped film can be conveyed out of the cartridge. As the state of a darkroom is formed, the film can be conveyed out of the cartridge by simply providing the cartridge adapter at the outer side of a negative developing apparatus in an illuminated room. For example, as shown in FIG. 9, a lid member 99, which has been rotatably mounted to a side wall 90A so as to correspond to the opening portion 92, can be formed as the shading member. In this case, after the cartridge 12 is inserted into the case 90, the lid member 99 can be rotated so as to close the opening portion 92. When the opening portion 92 is closed by the lid member 99, in order to prevent accidentally rotating the lid member 99 in the opposite direction and to prevent opening of the opening portion 92, an engaging hole can be provided at one of the lid member 99 and the side wall 90A and an engaging projection, which engages with the engaging hole, can be provided at the other of the lid member 99 and the side wall 90A.

What is claimed is:

1. A cartridge adapter, comprising:

a case into which a cartridge of a photographic film is loaded, said cartridge, including:

a door for shielding an entrance/exit port of the photographic film;

a door shaft which is rotated in a first direction so as to open said door and release the shielding of said entrance/exit port, said door shaft being rotated in a second direction which is the direction opposite said first direction so as to close said door and shield said entrance/exit port; and a spool shaft which is rotated in a third direction so that the photographic film is wound around the spool shaft, said spool shaft being rotated in a fourth direction which is the direction opposite said third direction so that said photographic film is conveyed out of said entrance/exit port; and a shaft body which is axially supported by said case so as to be rotatable and which engages with said door shaft of said cartridge loaded into said case, wherein said case is provided with a slit port which, when said photographic film is loaded into and unloaded from said cartridge, guides said photographic film, and an opening portion which exposes the end of the spool shaft of said cartridge loaded into said case.

2. A cartridge adapter according to claim 1, wherein said engagement between said door shaft and said shaft body is effected via a first key hole provided at said door shaft, and a second key hole, which engages with a driver for rotating said spool shaft, and which is formed at said spool shaft.

3. A cartridge adapter according to claim 2, wherein said slit port is formed at a position which corresponds to said door of said cartridge loaded into said case, and an edge portion of said case which forms said slit port is covered by non-woven fabric.

4. A cartridge adapter according to claim 1, wherein said slit port is formed at a position which corresponds to said door of said cartridge loaded into said case, and an edge portion of said case which forms said slit port is covered by non-woven fabric.

5. A cartridge adapter according to claim 1, further comprising:

a controlling projection in which, when said photographic film passes through said slit port, movements of the photographic film in the transverse direction are controlled.

6. A cartridge adapter according to claim 1, wherein a shielding member which shields said opening portion of said case so that the interior of said case is in the state of a darkroom is further provided.

7. A cartridge adapter, comprising:

a box having a loading portion into which a cartridge of a photographic film is loaded, said cartridge, including:

a door for shielding an entrance/ exit port of the photographic film;

a door shaft which is rotated in a first direction so as to open said door and release the shielding of said entrance/exit port, said door shaft being rotated in a second direction which is the direction opposite said first direction so as to close said door and shield said entrance/ exit port; and a spool shaft which is rotated in a third direction so that the photographic film is wound around the spool shaft, said spool shaft being rotated in a fourth direction which is the direction opposite said third direction so that said photographic film is conveyed out of said entrance/exit port;

a lid which is formed so as to be placed at an opened position at which said cartridge is able to be loaded into said loading portion and at a closed position at which said cartridge is contained at said loading portion; and a shaft body which engages with said door shaft of said cartridge loaded into said box, wherein a slit port which, when said photographic film is loaded into and unloaded from said cartridge, guides said photographic film and is formed between said box and said lid placed at said closed position, and said box includes an opening portion which exposes the end of the spool shaft of said cartridge loaded into said box.

8. A cartridge adapter according to claim 7, wherein said engagement between said door shaft and said shaft body is effected via a first key hole provided at said shaft body, and a second key hole, which engages with a driver for rotating said spool shaft, is formed at said spool shaft.

9. A cartridge adapter according to claim 8, wherein said slit port is placed at a position which corresponds to said door of said cartridge loaded into said box, and an edge portion of said box and an edge portion of said lid which form said slit port are covered by non-woven fabric.

10. A cartridge adapter according to claim 9, wherein guide means which guides said cartridge is formed at said box, such that, when said cartridge is loaded into said loading portion, said guide means holds a portion which forms said entrance/exit port of said cartridge, and said cartridge is slid along the axial direction of said door shaft, and said shaft body and said first key hole of said door shaft are engaged.

11. A cartridge adapter according to claim 10, wherein said lid is rotatably supported by said box so that said lid is positioned at said opened position and said closed position, said lid includes stopper means which stops the rotation of said lid in the direction of said opened position so that the angle of opening of said box and said lid forms a predetermined angle at said opened position, and said lid includes a guide portion which is formed at said lid and when said cartridge is guided by said guide means in a state in which said lid is positioned at said opened position, a predetermined portion of said cartridge slides.

12. A cartridge adapter according to claim 8, wherein guide means which guides said cartridge is formed at said box, such that, when said cartridge is loaded into said loading portion, said guide means holds a portion which forms said entrance/exit port of said cartridge, and said cartridge is slid along the axial direction of said door shaft, and said shaft body and said first key hole of said door shaft are engaged.

13. A cartridge adapter according to claim 12, wherein said lid is rotatably supported by said box so that said lid is positioned at said opened position and said closed position, said lid includes stopper means which stops the rotation of said lid in the direction of said opened position so that the angle of opening of said box and said lid forms a predetermined angle at said opened position, and said lid includes a guide portion which is formed at said lid and when said cartridge is guided by said guide means in a state in which said lid is positioned at said opened position, a predetermined portion of said cartridge slides.

14. A cartridge adapter according to claim 7, further comprising:

a controlling projection in which, when said photographic film passes through said slit port, movements of the photographic film in the transverse direction are controlled.

15. A cartridge adapter according to claim 7, wherein said slit port is placed at a position which corresponds to said door of said cartridge loaded into said box, and an edge portion of said box and an edge portion of said lid which form said slit port are covered by non-woven fabric.

16. A cartridge adapter according to claim 15, wherein guide means which guides said cartridge is formed at said box, such that, when said cartridge is loaded into said loading portion, said guide means holds a portion which forms said entrance/exit port of said cartridge, and said cartridge is slid along the axial direction of said door shaft, and said shaft body and said first key hole of said door shaft are engaged.

17. A cartridge adapter according to claim 16, wherein said lid is rotatably supported by said box so that said lid is positioned at said opened position and said closed position, said lid includes stopper means which stops the rotation of said lid in the direction of said opened position so that the angle of opening of said box and said lid forms a predetermined angle at said opened position, and said lid includes a guide portion which is formed at said lid and when said cartridge is guided by said guide means in a state in which said lid is positioned at said opened position, a predetermined portion of said cartridge slides.

18. A cartridge adapter according to claim 7, wherein said box is provided with an opening for extrusion, in which said cartridge loaded into said loading portion is able to be extruded from said loading portion.

19. A cartridge adapter according to claim 7, further comprising:

lock means which, when said lid is placed at said closed position, maintains the closed position.

20. A cartridge adapter according to claim 7, further comprising:

a shielding member which shields said opening portion of said box so that the interior of said loading portion is in the state of a darkroom.

* * * * *